United States Patent [19]

Langer et al.

[11] Patent Number: 4,984,633

[45] Date of Patent: Jan. 15, 1991

[54] NOZZLE EFFECT PROTECTORS, CENTRALIZERS, AND STABILIZERS AND RELATED METHODS

[75] Inventors: Friedrich H. Langer; Michael J. Woodward, both of Houston, Tex.

[73] Assignee: Weatherford U.S., Inc., Houston, Tex.

[21] Appl. No.: 424,092

[22] Filed: Oct. 20, 1989

[51] Int. Cl.[5] ..... E21B 17/10; E21B 17/16

[52] U.S. Cl. ..... 166/241; 166/173; 166/222; 175/325; 175/323

[58] Field of Search ..... 166/378, 380, 241, 173, 166/177, 222, 223, 242; 175/325, 323

[56] References Cited

U.S. PATENT DOCUMENTS

| | | | |
|---|---|---|---|
| 1,460,632 | 7/1923 | Wigle et al. . | |
| 1,767,198 | 6/1930 | Baker . | |
| 2,166,116 | 7/1939 | Bettis | 166/241 |
| 2,166,937 | 7/1939 | Bettis | 166/241 |
| 2,237,863 | 4/1941 | Donaldson . | |
| 2,295,803 | 9/1942 | O'Leary | 166/173 |
| 2,307,688 | 1/1943 | Larson | 175/325 |
| 2,312,600 | 3/1943 | Steps . | |
| 2,388,416 | 11/1945 | Johnson . | |
| 2,424,027 | 7/1947 | Gist . | |
| 2,622,684 | 12/1952 | Kluck . | |
| 2,636,564 | 4/1953 | Kluck . | |
| 2,794,617 | 6/1957 | Yancey | 166/241 |
| 2,973,996 | 3/1961 | Self | 308/4 A |
| 3,072,195 | 1/1963 | Kluck | 166/241 |
| 3,164,216 | 1/1965 | Hall et al. . | |
| 3,397,017 | 8/1968 | Grant . | |
| 4,042,023 | 8/1977 | Fox . | |
| 4,245,708 | 1/1981 | Cholet et al. | 175/325 |
| 4,422,504 | 12/1983 | Moore . | |
| 4,610,316 | 9/1986 | Boaz | 175/325 |
| 4,658,896 | 4/1987 | Milam | 166/241 |
| 4,766,663 | 8/1988 | Milam . | |

FOREIGN PATENT DOCUMENTS

| | | | |
|---|---|---|---|
| 1231642 | 2/1985 | Canada . | |
| 1201482 | 12/1985 | U.S.S.R. | 175/325 |
| 1384708 | 3/1988 | U.S.S.R. | 175/325 |
| 2138056 | 4/1983 | United Kingdom . | |
| 2171436 | 2/1985 | United Kingdom . | |
| 2197008 | 5/1988 | United Kingdom | 175/325 |

OTHER PUBLICATIONS

Weatherford 1988 Annual Report, p. 1, Oilfield Products and Equipment Products and Services Catalog 1986–1987, Weatherford 1985, pp. 22–30, 43.

Christensen Downhole Tools—Stabilzier, pp. 2034–2041, 1982.

*Primary Examiner*—Bruce M. Kisliuk

*Attorney, Agent, or Firm*—Guy McClung

[57] ABSTRACT

Nozzle-effect well apparatuses including nozzle-effect protectors, centralizers and stabilizers and related methods, the apparatuses having two or more blades or ribs extending outwardly from a body, the blades or ribs spaced apart further at one end of the apparatus than the other; in one embodiment, the wall thickness of the apparatus varying so that one end is thicker than the other or a portion or portions between the ends are thicker or thinner in wall thickness than other portions; in another embodiment, portions of valley areas between ribs or blades varying in size to create nozzle effects.

13 Claims, 8 Drawing Sheets

NOZZLE EFFECT PROTECTORS, CENTRALIZERS, AND STABILIZERS AND RELATED METHODS

BACKGROUND OF THE INVENTION

1. Field of the Invention

This invention is directed to protectors, stabilizers, and centralizers for use in wellbore operations, including, in one specific embodiment centralizers for use with casing. In another embodiment this invention is particularly directed to devices which create or enhance turbulence in well fluids with a nozzle effect.

2. Description of Related Art

In various well operations a tubular member used in a wellbore needs to be protected, stabilized, or centralized. For example, wellbores are often lined with a string of casing. The casing is held in place by cement which, prior to hardening, is pumped down the string of casing and then flows out from the bottom of the casing and thence upwardly in the annulus between the exterior of the casing and the interior of the wellbore. A variety of problems are encountered if the casing is not centered in the wellbore. It is also important for the upflowing cement to push ahead of it any drilling mud that may have remained in or on the wellbore. Various devices and methods have been employed to provide for centralizing the casing and to tubulently "scour" unwanted mud cake from the interior wall of a wellbore.

Stabilizers for drill pipe are common. They are employed to inhibit or prevent transverse movement of drill pipe within a well while permitting normal free rotation and longitudinal movement of the pipe. Various stabilizers have protruding ribs which define longitudinal passages which permit circulation of drilling fluids and of cuttings resulting from drilling. Drill pipe stabilization controls deviation of a wellbore, minimizes the severity of doglegs, and optimizes drill pipe performance by providing for coaxial rotation. Stabilizers are available as sleeves or as an integral string component.

In accordance with 37 C.F.R. 1.56 the following are disclosed:

U.S. Pat. No. 3,072,195 discloses a slip over collar-type centralizer which attempts to create a turbulent action in a cement slurry so that the swirling action of the cement will remove mud cake clinging to the wellbore walls. This is accomplished by an agitator device which has a plurality of inclined blades.

U.S. Pat. No. 2,973,996 discloses a stabilizer for drill pipe with a plurality of spiral-shaped ribs.

U.S. Pat. No. 4,658,896 discloses a centralizer with a plurality of protuberances for imparting turbulent action to a cement slurry and structure to clean mud cake from a wellbore wall.

U.K. Patent No. 2,171,436 discloses a centralizer/-stabilizer with a plurality of extending rigid blades.

"Oilfield Products and Equipment," page 1, Weatherford 1988 Annual Report shows a general diagram of a typical drilling operation.

"Products and Services Catalog 1986–87," Weatherford 1985, discloses typical centralizers, wipers, and clamps, pages 22–30; and typical stabilizer sleeves, page 43.

Related prior art of which applicants are aware include

U.S. Pat. Nos. 1,460,632; 1,767,198; 2,237,863; 2,312,600; 2,388,416; 2,424,027; 2,622,684; 2,636,564; 3,164,216; 3,397,017; 4,042,023; 4,422,504; 4,766,663 (Division of U.S Pat. No. 4,658,896); Canadian Patent No. 1,231,642; U.K. Patent No. 2,138,056B and "Christensen Downhole Tools—Stabilizers" pages 2034–2041.

There has long been a need for a downhole device that creates or enhances turbulence in a flow of material in a wellbore such as, but not limited to, drilling fluid, drilling fluid with cuttings or other material, or cement slurries.

SUMMARY OF THE PRESENT INVENTION

The present invention is directed to device for use in well operations, including but not limited to drilling and cementing operations, which make the flow of fluid past the device more turbulent to effect a more homogeneous flow or to effect removal of unwanted materials from the interior of a wellbore or from the wall of a wellbore. In one embodiment of the present invention such a device, including but not limited to protectors, centralizers, or stabilizers, has a plurality of ribs protruding from and spaced apart on a generally cylindrical hollow body with the ribs extending from near one end of the body to near the other end of the body and with the rib width differing from one end of the body to the other so that a nozzle effect is created by adjacent ribs and the valley between them. In another embodiment of a device according to the present invention the device has a generally cylindrical hollow body member with a plurality of protruding ribs wherein the body is formed so that its wall thickness at one end differs from its wall thickness at the other end so that in coaction with the wellbore wall a nozzle effect is created which initiates or augments turbulent action of a fluid flowing past the device.

In another embodiment of a device according to the present invention sub-units are provided with at least one tongue or at least one notch for interengaging another sub-unit with a complimentary notch or tongue. In specific embodiments centralizers, protectors, or stabilizers can be provided with pluralities of tongues and notches for interengagement.

In yet another embodiment of the present invention a device is provided which has a body with protruding ribs that are wider at the ends than they are in the middle; or with body wall thickness thinner at the ends than in the middle; or a combination of both features.

Further embodiments of this invention provide methods which employ devices according to this invention.

It is therefore an object of at least preferred embodiments of this invention to provide new, useful, unique, and nonobvious nozzle effect devices for use in well operations, including, but not limited to, centralizers, stabilizers, and protectors for use on tubular members, and methods employing them.

Another object of at least preferred embodiments of this invention is to address and satisfy the long-felt need for such devices and methods.

Yet another object of at least preferred embodiments of the present invention is the provision of such devices which employ a body with protruding ribs with differing widths to create a nozzle effect on well fluids and materials flowing past the device.

A further object of at least preferred embodiments of the present invention is the provision of devices with varying wall thicknesses to create a nozzle effect between the devices and a nearby device's surface or a wellbore wall.

An additional object of at least preferred embodiments of this invention is the provision of interengageable sub-units which can be combined to produce a device according to this invention of desired size for a particular application.

Another object of at least preferred embodiments of this invention is the provision of methods using the various devices according to this invention.

The present invention recognizes and addresses the previously-mentioned unaddressed long-felt needs and provides a satisfactory meeting of those needs in its various embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions or further improvements.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

DESCRIPTION OF PRESENTLY PREFERRED EMBODIMENTS

Figure 1A:
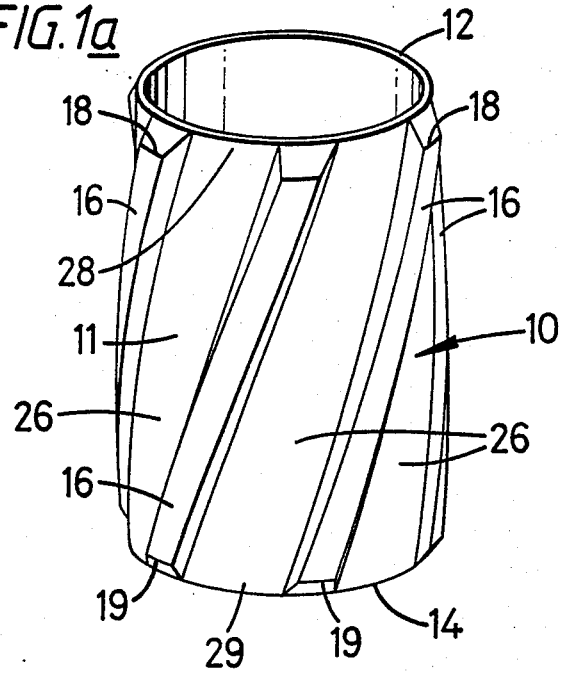
FIG. 1*a* is a perspective view of a centralizer according to the present invention.
Figure 1C:
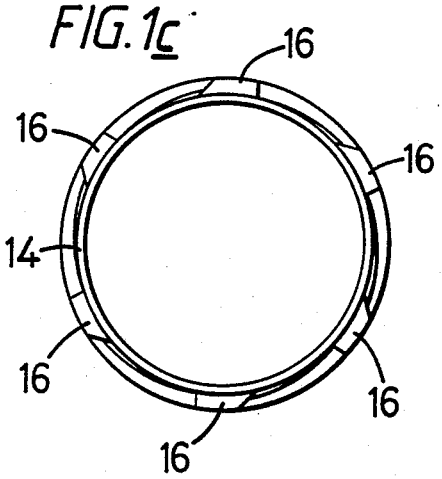
FIG. 1*c* is a bottom view in crosssection of the device of FIG. 1*a*.
Figure 1B:
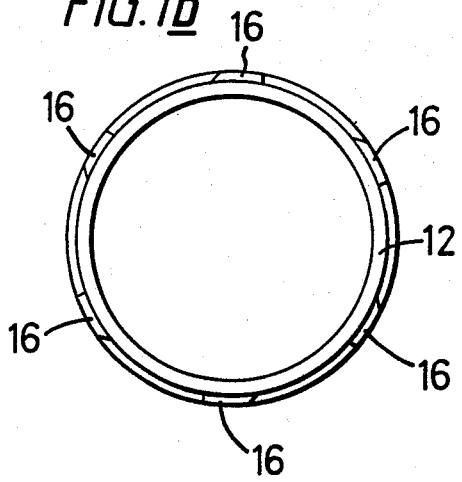
FIG. 1*b* is a top view in crosssection of the centralizer of FIG. 1*a*.

Referring now to FIGS. 1*a*,1*b*,1*c*, a centralizer 10 according to the present invention has a generally cylindrical slightly conical hollow body 11 with an upper body 12 which is thicker in wall thickness than a lower body 14. The difference in wall thickness is a gradual increase from the lower body 14 to the upper body 12. When the centralizer 10 is placed within a wellbore of generally uniform diameter (or in a tubular of generally uniform diameter) a nozzle effect on fluids and materials flowing past the centralizer is created in the space between the centralizer's outer surface and the interior wall of the wellbore due to the gradual change in thickness of the centralizer's body.

The centralizer 10 has a plurality of protruding ribs 16 which are spaced apart on the outer surface of the body 11 and are inclined with respect to a longitudinal axis of the centralizer 10. The ribs 16 are wider at an upper rib area 18 than at a lower rib area 19 and the rib gradually increases in width from the bottom of the body 11 to its top. A valley 26 defines an area between each pair of consecutive ribs 16. A top area 28 of the valley 26 is narrower than a bottom area 29 of the valley 26 and the valley width (the distance between ribs at a given point) gradually decreases from the bottom 14 of the body 11 to its top 12.

The configuration and disposition of the obliquely extending ribs 16 and the valleys 26 creates another nozzle effect on fluids and materials flowing past the outer surface of the centralizer since fluid flowing from the bottom of the centralizer encounters an ever-decreasing space in which to move upwardly between the ribs 16.

Figure 2:
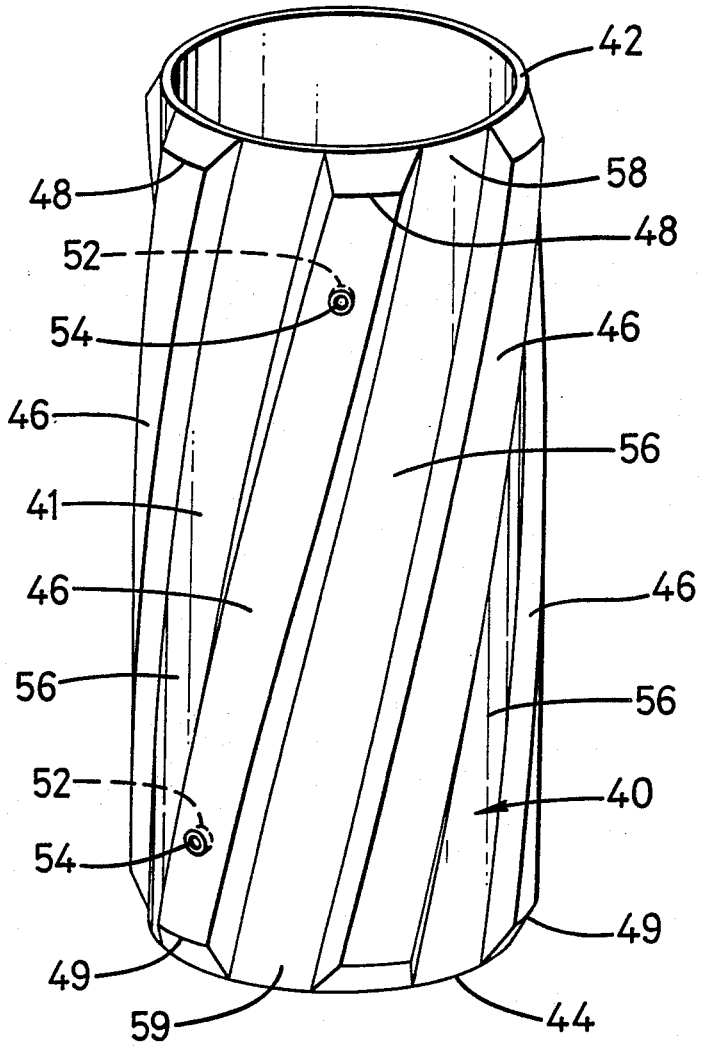
FIG. 2 is a perspective view of a centralizer according to the present invention.

Referring now to FIG. 2 a centralizer 40 has a generally cylindrical hollow body 41 with a body bottom 44, a body top 42, and a plurality of ribs 46 protruding from and spaced apart on the outer surface of the body 41 and inclined with respect to a longitudinal axis at the centralizer 40. Valleys 56 having top valley areas 58 and bottom valley areas 59 extend between pairs of consecutive ribs 46. Recesses 52 through a rib 16 and through the body 41 hold set screws 54 for attaching the centralizer 40 to a tubular member such as casing in a casing string.

A top area 48 of the ribs 46 is wider than a bottom area 49 of the ribs and a top area 58 of the valleys 56 is narrower than a bottom area 59 of the valleys so that the same nozzle effect is created by the centralizer 40 as by the ribs and valleys of the centralizer 10 (FIG. 1*a*).

Figure 3:
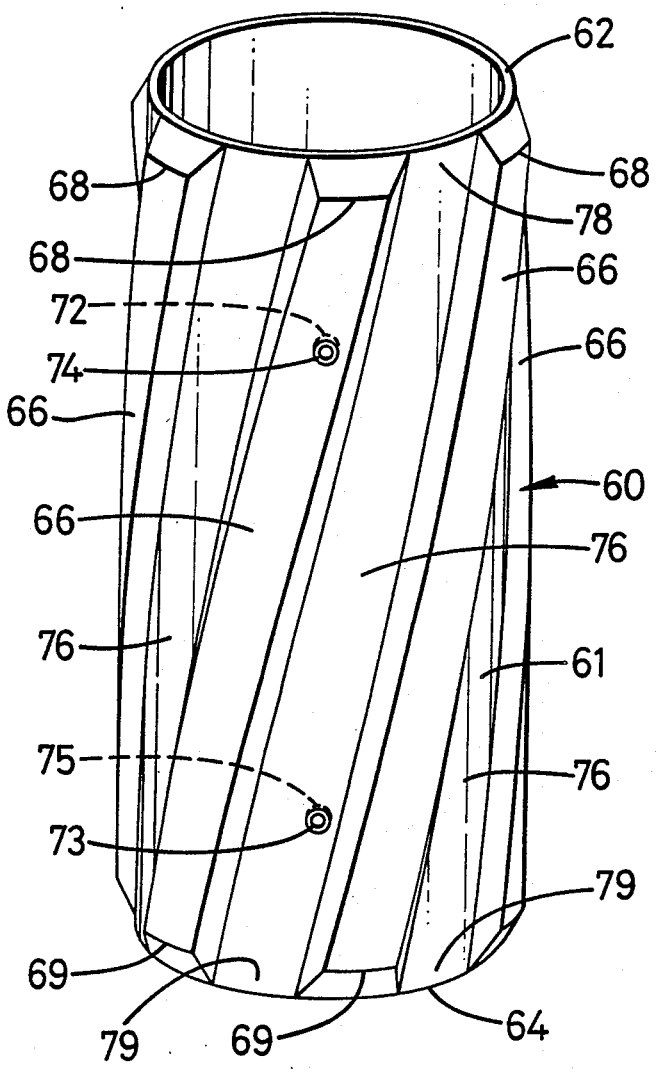
FIG. 3 is a perspective view of a centralizer according to the present invention.

Referring now to FIG. 3 a centralizer 60 is similar to the centralizer 40, but one set screw 74 extends through a recess 72 in a rib 66 and through the body 61, while another set screw 73 extends through a recess 75 in a valley 76 through the body 61. The centralizer 60 has ribs 66 and rib top areas 68 and rib bottom areas 69, the rib width gradually increasing from a bottom 64 of the body 61 to a top 62 of the body 61. The width of the valleys 76 between consecutive ribs 66 gradually decreases from a valley bottom area 79 to a valley top area 78. The rib-valley configuration of the centralizer 60 creates a nozzle effect like that of the centralizers 10 and 40 previously discussed.

The wall thickness of the body 41 of the centralizer 40 and of the body 61 of the centralizer 60 can be varied to produce a nozzle effect like that of the centralizer 10.

Figure 4:
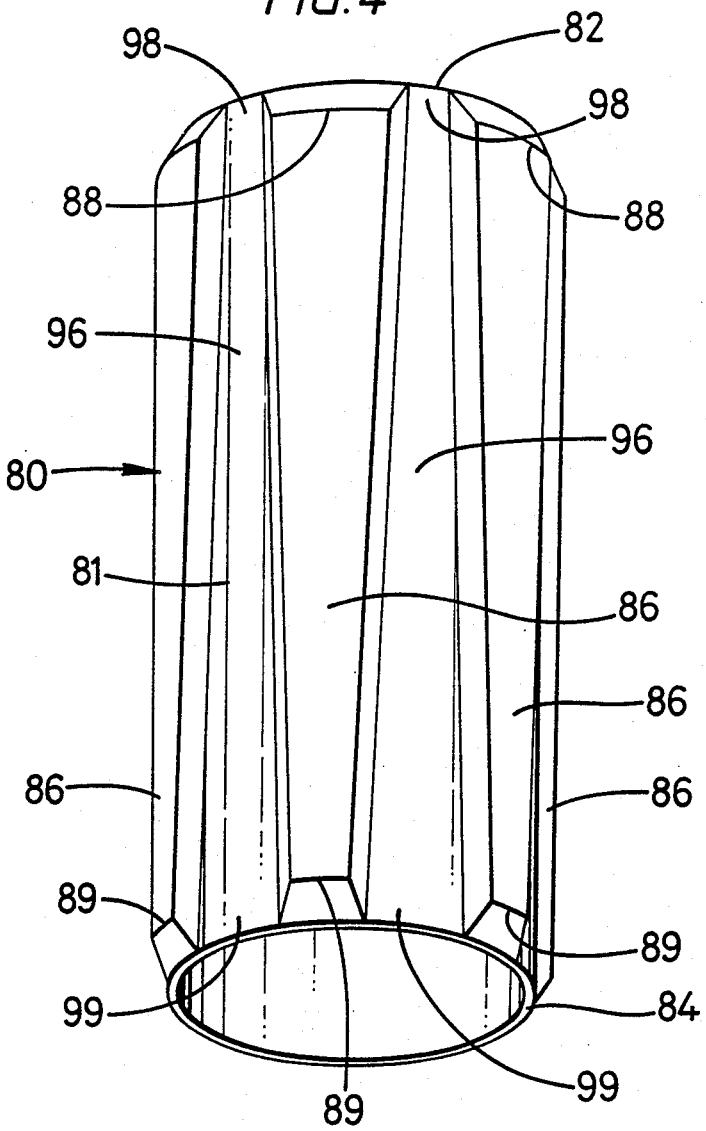
FIG. 4 is a perspective view of a centralizer according to the present invention.

Referring now to FIG. 4, a centralizer 80 has a body 81 which is generally cylindrical and is hollow with a bore therethrough (like the bodies 11, 41 and 61), and has a plurality of ribs 86 protruding from and spaced apart on the outer surface of the body 81. Each rib 86 gradually increases in width from a bottom rib portion 89 to a top rib portion 88. Valleys 96 between consecutive ribs gradually decrease in width from a valley bottom area 99 to a valley top area 98. Thus, a nozzle effect is created with the centralizer 80 as with the previously described centralizers. The ribs 86 extend generally vertically on the body 81 rather than obliquely as do the ribs on the centralizers 10,40, and 60.

Figure 5:
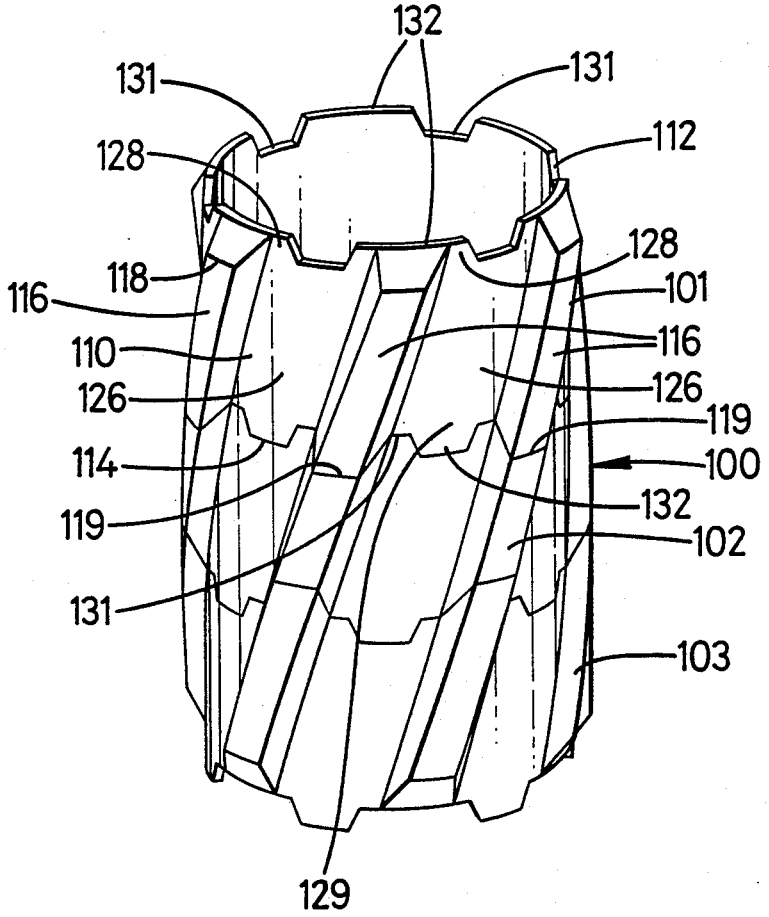
FIG. 5 is a perspective view of a multi-component centralizer according to the present invention.

A centralizer 100 shown in FIG. 5 is a multi-component centralizer made with a plurality (two or more) sub-units, in this case three substantially similar centralizers 101, 102, and 103. Only centralizer 101 will be described in detail here since centralizers 102 and 103 are similar.

The centralizer 101 has a body 110 which is generally cylindrical and hollow and which has a plurality of ribs 116 protruding from and spaced apart on its outer surface. Each rib 116 extends from a bottom 114 of the body 110 to a top 112 of the body 110 obliquely at an incline to the longitudinal axis of the centralizer.

A valley 126 extends between consecutive ribs 116. The width of the valley 126 decreases gradually upwardly from a bottom 129 of each valley 126 to a top 128 of each valley 126 so that a nozzle effect is created between the ribs 116, the valleys 126, and the wall of the wellbore in which the centralizer is situated (or the interior wall of a tubular in which the centralizer is disposed).

Around the upper part of the body 110 a plurality of tongues 132 and a plurality of notches 131 are disposed and spaced apart. Similarly such tongues and notches alternate around the lower part of the body 110. The centralizers 102 and 103 have corresponding tongues and notches so that adjacent centralizers (101, 102 and 102, 103) coact—the upper notches of centralizer 102 receive the lower tongues of centralizer 101; the upper notches of centralizer 103 receive the lower tongues of centralizer 102. Thus the proper combination of sub-units and their proper alignment can be assured. Using such sub-units also permits the construction of a centralizer of a desired length when using tubulars (e.g. casing) of different length.

The centralizer 100 can be constructed of sub-units with varying wall thickness to create a multi-component centralizer in which from the bottom of the lowest sub-unit (e.g. centralizer 103) to the top of the highest sub-unit (e.g. centralizer 101) the wall thickness gradually increases to create the previously-described nozzle effect. By using appropriately and differently sized tongues and notches correct assembly of the multi-component centralizer could be made foolproof; e.g. the tongues on centralizer 101 could be fashioned so that they fit only onto the notches at the upper portion of the centralizer 102. The ribs 116 can be fashioned with increasing width so that the decrease in valley width is more pronounced. Similarly, the plural constructed ribs which extend from the bottom of the centralizer 103 to the top of the centralizer 101 can be fashioned so that one continuous rib extends from the bottom of centralizer 103 to the top of centralizer 101 with a gradually increasing width to effect an overall nozzle effect as previously described herein.

Figure 6A:
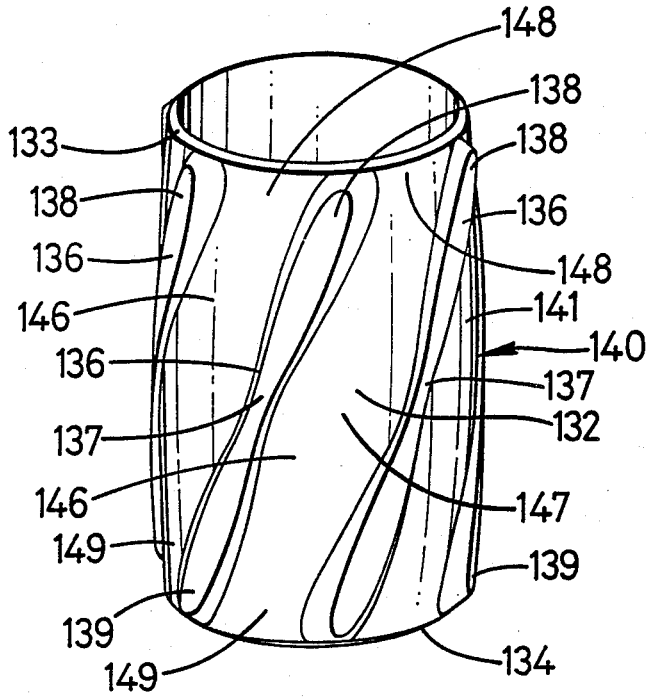
FIG. 6*a* is a view of a centralizer according to the present invention.
Figure 6B:
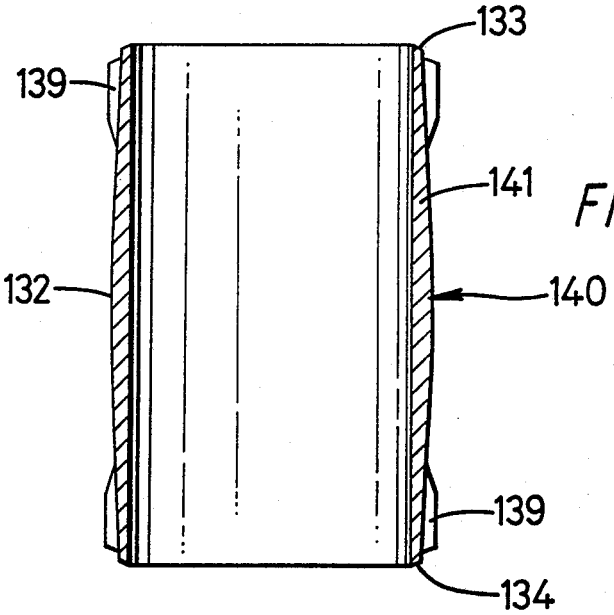
FIG. 6*b* is a longitudinal crosssection view of the centralizer of FIG. 6*a*.

As shown in FIGS. 6*a* and 6*b*, a centralizer 140 has a generally cylindrical hollow body 141 with a bore therethrough and with a plurality of ribs 136 protruding from and spaced apart on the outer surface of the body 141.

As illustrated in FIG. 6*b*, the wall thickness of the body 141 varies from thinner at ends 133 and 134 to thicker at a mid portion 132. The width of the ribs 136 varies from wider near their ends 138 and 139 to narrower in their mid portions 137 to form valleys 146 which are narrower at their upper portions 148 and lower portions 149 than at valley mid portions 147.

The configuration of varying wall thickness, varying rib width, and varying valley width serves to create multiple nozzle effects to enhance turbulence of a fluid or materials moving past the centralizer 140. By providing the relatively large mid portions 147 in the valleys 146, the amount of fluid or material flowing over the thick mid-portion 132 of the body is not impeded; i.e., no additional pressure drop will occur. Although in the preferred embodiment illustrated in FIG. 6*a* the valley mid portions are located near the center of the body 141, it is within the scope of this invention for the enlarged valley portions to be located nearer to either end of the body. Also, although the centralizer 140 combines both varying wall thickness and varying rib and valley widths, it is within the scope of this invention to provide a well apparatus (e.g. centralizer, protector, stabilizer) which has only the varying wall thickness or only the rib-valley configuration of the centralizer 140. Also a centralizer like the centralizer 100 can be constructed, in accordance with this invention, of sub-units that are the same so that ends of adjacent sub-units can have different wall thicknesses, and ribs (and valleys) at the ends of adjacent sub units can have different widths; i.e., the smooth flowing overall surface of the centralizer 100 from top to bottom, edge-to-edge, end-to-end, rib-to-rib, would not be present.

Figure 7:
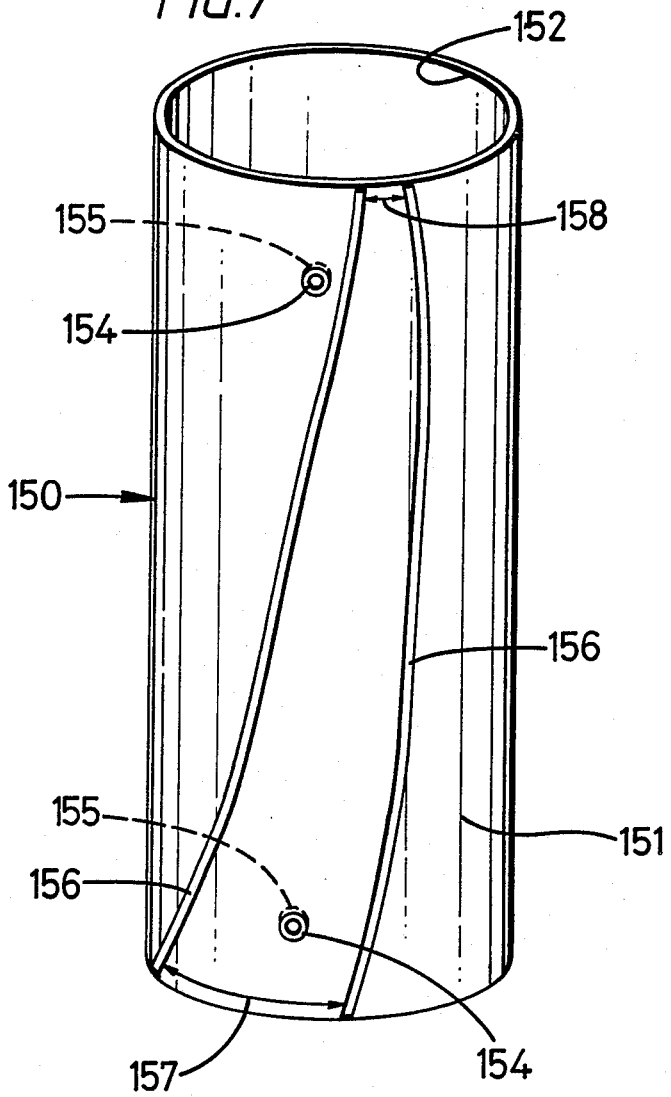
FIG. 7 is a perspective view of a clamp according to the present invention.

Referring to FIG. 7 a turbulating clamp 150 has a body 151 which is generally cylindrical and hollow with a bore 152 therethrough and a plurality of blades 156 (two shown) protruding from and spaced apart on the outer surface of the body 151. The distance 157 between the blades at one end of the clamp is greater than the distance 158 between the blades at the other end of the clamp; thus coacting with a wellbore's interior wall or the interior wall of a tubular in which the clamp is disposed, the blades serve to create a nozzle-effect area which serves to render turbulent or enhance the turbulence of fluid or fluid and material flowing around or past the exterior surface of the clamp. It is also within the scope of the present invention to vary the wall thickness of the body 151 to achieve the effects of a device, such as the centralizer 10 (FIG. 1*a*) whose wall thickness varies. Set screws 155 in bores 154 which extend through the body 151 may be used to secure the clamp 150 to a tubular member (not shown) about which the clamp 150 is disposed. It is also within the scope of the present invention to provide the clamp 150 with tongues and notches like the centralizer sub-unit 101 (FIG. 5).

Figure 8:
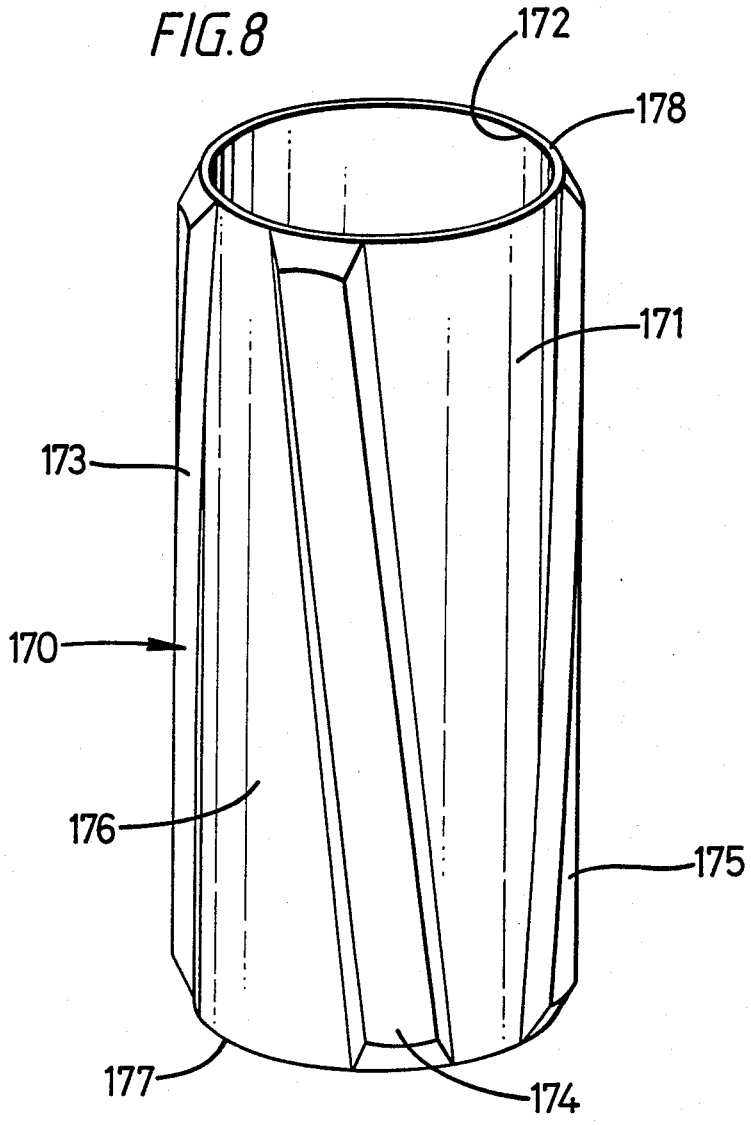
FIG. 8 is a perspective view of a centralizer according to the present invention.

Referring now to FIG. 8 a centralizer 170 has a generally cylindrical hollow body 171 with a bore 172 therethrough and a plurality of ribs (173,174,175 are shown) protruding from and spaced apart on the exterior surface of the body 171. Between adjacent pairs of ribs, e.g. ribs 173, 174, a valley 176 extends which grows progressively smaller from one end 177 of the body 171 to the other end 178 of the body 171; thus, coacting with the interior surface of a wellbore or a tubular member in which the centralizer 170 is disposed, the ribs 173,174 create a nozzle-effect area which serves to render turbulent or enhance the turbulence of a fluid or a fluid and material flowing around or past the exterior surface of the centralizer. It is also within the scope of this invention to vary the wall thickness of the body 171 like the wall thickness of the body 11 of the centralizer 10 (FIGS. 1*a*–1*c*) and/or to provide the centralizer 170 with tongues and notches like those of centralizer subunit 101 (FIG. 5).

Although in the preferred embodiments disclosed herein ribs or blades extend from one end of a device to the other, it is within the scope of this invention to utilize blades or ribs which do not extend from one end of a body to the other, but do extend sufficiently to create a nozzle effect.

In conclusion, therefore, it is seen that the present invention and the embodiments disclosed herein are well adapted to carry out the objectives and obtain the ends set forth at the outset. Certain changes can be obviously made in the methods and apparatuses without departing from the spirit and the scope of this invention.

While there have been described various embodiments of the present invention, the methods and apparatuses described are not intended to be understood as limiting the scope of the invention. It is realized that changes therein are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized.

What we claim is:

1. Centralizer apparatus for use in well operations with a string of tubular members, the apparatus comprising a generally cylindrical hollow body having an inner surface and an outer surface and a top and a bottom and disposable on the outside of a tubular member of the string of tubular members, a plurality of ribs protruding from and spaced apart on the body, each rib extending along the body, for enhancing the turbulence of a flow of a fluid or material past the apparatus's outer surface, a distance at the top of the apparatus between consecutive ribs differing from a distance at the bottom of the apparatus between said consecutive ribs, and the body having a wall thickness thicker at the top than at the bottom to enhance the flow of the material past the apparatus.

2. The apparatus of claim 1 wherein the body has a top an a bottom end edge with one or more notches formed therein with extending tongues projecting from between notches, the tongues wider than the ribs, each notch fashioned for receiving a tongue protruding from an edge of another adjacent well device, the adjacent well device having ribs that line up with the ribs of the apparatus to form continuous ribs.

3. The apparatus of claim 1 wherein the ribs extend obliquely along the outer surface of the body.

4. A casing centralizer for use in well operations with a string of casing members, the centralizer comprising a generally cylindrical hollow body having an inner surface and an outer surface and a top and a bottom and disposable on the exterior of a casing member of the string of casing members, the body having a wall thickness thicker at one end that the other to enhance the flow of the material past the centralizer, the body having an end edge and one or more notches protruding from the end edge, each notch fashioned for receiving a tongue protruding from an edge of another adjacent centralizer, a plurality of ribs protruding from and spaced apart on the body, and extending obliquely along the outer surface of the body, each rib extending from near the top of the body to near the bottom of the body, for enhancing turbulence of a flow of a material past the centralizer's outer surface, and a distance at the top of the centralizer between consecutive ribs differing from a distance at the bottom of the centralizer between said consecutive ribs.

5. A centralizer for use with a string of tubular members, the centralizer comprising a generally cylindrical hollow body having an inner surface and an outer surface, a top and a bottom, a top and a bottom end, and disposable on the exterior surface a tubular member of the string of tubular members, a plurality of ribs protruding from and spaced apart on the body, and the body having a wall thickness at one end thicker than the other to enhance the flow of the material past the centralizer.

6. A multi-component device for use in well operations with a string of tubular members, the device comprising a plurality of two or more units, each unit having a generally cylindrical hollow body having an inner surface and an outer surface, a top with a top edge and a bottom with a bottom edge, the body disposable on the exterior surface of a tubular member of the string of tubular members, a plurality of ribs protruding from and spaced apart on the body, the edges of the body of one unit having a plurality of notches and tongues for interengagement with an adjacent unit so that the ribs of the two or more units line up to form continuous ribs.

7. The multi-component device of claim 6 wherein the ribs of each unit extend from near the top to near the bottom of the body and wherein the ribs differ in width at one end of the body as compared to their width at the other end.

8. The multi-component device of claim 6 wherein the tubular members are casing and the multi-component device is a casing centralizer.

9. A device for use in well operations with a string of tubular members, the device comprising a generally cylindrical hollow body having an inner surface and an outer surface, a top with a top edge, a bottom with a bottom edge, and a mid portion, the body disposable on the exterior surface of a tubular member of the string of tubular members, a plurality of ribs protruding from and spaced apart on the body, each rib extending from near the top of the body to near the bottom of the body for enhancing the turbulence of a flow of a material past the device's outer surface, each rib having a top end near the top of the body, a bottom end near the bottom of the body, and a mid portion near the mid portion of the body, the tops and bottoms of the ribs wider than the mid portion of the ribs.

10. The device of claim 9 wherein the tubular members are casing and the device is a casing centralizer.

11. A device for use in well operations with a string of tubular members, the device comprising a generally cylindrical hollow body having a inner surface and an outer surface, a top with a top edge, a bottom with a bottom edge, and a mid portion, the body disposable on a tubular member of the string of tubular members, a plurality of ribs protruding from and spaced apart on the body, each rib extending from near the top of the body to near the bottom of the body for enhancing the turbulence of a flow of material past the device's outer surface, each rib having a top end near the top of the body, a bottom end near the bottom of the body, a mid portion near the mid portion of the body, the tops and bottoms of the ribs wider than the mid portion of the ribs, and wherein a wall thickness of the top and bottom of the body is thinner than a wall thickness of the mid portion of the body.

12. A turbulating clamp for use in well operations, the clamp disposable on the exterior of a tubular member to be disposed in a wellbore, the turbulating clamp comprising a generally cylindrical hollow body having an inner surface and an outer surface, a top and a bottom, and a bore therethrough from top to bottom so that the body is disposable on and about the tubular member, a plurality of blades protruding from and spaced apart on the outer surface of the body, each blade having a first end and a second end and extending along the body for enhancing the turbulence of a flow of a fluid or material past the body's outer surface, pairs of the blades separated from each other a larger distance at their first ends than at their second ends, and the body having a wall thickness thicker at the top than at the bottom to enhance the turbulence of the fluid or material.

13. A method for rendering turbulent a flow of fluid or material in a wellbore, the method comprising the steps of emplacing on an exterior surface of a tubular member of a string of tubular members a turbulent flow apparatus comprising a generally cylindrical hollow body having an inner surface, an outer surface, a top, a bottom, a bore therethrough from top to bottom so that the body is disposable on and about the tubular member, a plurality of projections protruding from and spaced apart on the body, each projection extending along the body for enhancing the turbulence of flow of a fluid or material past the turbulent flow apparatus's outer surface, and at least one pair of the projections separated from each other a larger distance at a first point than at a second point spaced apart from the first point, the body having a wall thickness thicker at the top than at the bottom to enhance the flow of material past the apparatus, inserting the string of tubular members including the tubular member with the turbulent flow apparatus emplaced thereon into the wellbore so that fluid or material in the wellbore flows past the turbulent flow apparatus's outer surface.

* * * * *